US010439266B2

(12) United States Patent
Hwang et al.

(10) Patent No.: US 10,439,266 B2
(45) Date of Patent: Oct. 8, 2019

(54) WIDEBAND PATCH ANTENNA MODULE

(71) Applicant: AMOTECH CO., LTD., Incheon (KR)

(72) Inventors: Chul Hwang, Incheon (KR); In-Jo Jeong, Incheon (KR); Sang-O Kim, Incheon (KR); Ki-Hwan You, Incheon (KR); Dong-Hwan Koh, Seoul (KR)

(73) Assignee: Amotech Co., Ltd., Incheon (KR)

( * ) Notice: Subject to any disclaimer, the term of this patent is extended or adjusted under 35 U.S.C. 154(b) by 81 days.

(21) Appl. No.: 15/524,140

(22) PCT Filed: Dec. 10, 2014

(86) PCT No.: PCT/KR2014/012141
§ 371 (c)(1),
(2) Date: May 3, 2017

(87) PCT Pub. No.: WO2016/072555
PCT Pub. Date: May 12, 2016

(65) Prior Publication Data

US 2017/0317402 A1 Nov. 2, 2017

(30) Foreign Application Priority Data

Nov. 3, 2014 (KR) ..... 10-2014-0151182

(51) Int. Cl.
*H01Q 1/38* (2006.01)
*H01Q 1/24* (2006.01)
(Continued)

(52) U.S. Cl.
CPC ..... *H01Q 1/24* (2013.01); *H01Q 5/25* (2015.01); *H01Q 5/35* (2015.01); *H01Q 9/045* (2013.01); *H01Q 9/0435* (2013.01)

(58) Field of Classification Search
CPC ..... H01Q 1/24; H01Q 9/045; H01Q 13/08; H01Q 5/25; H01Q 5/35; H01Q 9/0435; H01Q 1/38
See application file for complete search history.

(56) References Cited

U.S. PATENT DOCUMENTS 4,827,271 A * 5/1989 Berneking ..... H01Q 9/0414 343/700 MS
5,270,722 A * 12/1993 Delestre ..... H01Q 9/0414 343/700 MS
(Continued)

FOREIGN PATENT DOCUMENTS

KR 20-0326365 Y1 9/2003
KR 10-2004-0005255 A 1/2004
(Continued)

OTHER PUBLICATIONS

Extended European Search Report in European Patent Application No. 14905447.0, dated Oct. 23, 2017.

*Primary Examiner* — Tho G Phan
(74) *Attorney, Agent, or Firm* — Baker & Hostetler LLP

(57) ABSTRACT

Disclosed is a wideband patch antenna module where two feeding points are formed on a lower patch at a preset angle therebetween, whereby ultra-wideband characteristics receiving both a GPS signal and a GLONASS signal may be realized, and antenna size and manufacturing costs may be minimized. The wideband patch antenna module includes a base layer; a radiation patch provided on a top surface of the base layer; a lower patch provided at a bottom surface of the base layer; a first feeding point provided at a bottom surface of the lower patch; and a second feeding point provided at the bottom surface of the lower patch, wherein an imaginary line connecting the first feeding point and a center point of
(Continued)

the lower patch intersects with an imaginary line connecting the second feeding point and the center point of the lower patch.

7 Claims, 16 Drawing Sheets

(51) Int. Cl.

| | |
|---|---|
| ***H01Q 9/04*** | (2006.01) |
| ***H01Q 5/25*** | (2015.01) |
| ***H01Q 5/35*** | (2015.01) |

(56) References Cited

U.S. PATENT DOCUMENTS

| | | | | |
|---|---|---|---|---|
| 6,252,553 | B1 * | 6/2001 | Solomon | H01Q 9/0407 343/700 MS |
| 7,209,080 | B2 * | 4/2007 | Crouch | H01Q 9/0435 343/700 MS |
| 7,460,071 | B2 * | 12/2008 | Manholm | H01Q 9/0428 343/700 MS |
| 9,653,808 | B2 * | 5/2017 | Hwang | H01Q 9/0414 |

FOREIGN PATENT DOCUMENTS

| | | | |
|---|---|---|---|
| KR | 10-2009-0051112 | A | 5/2009 |
| KR | 10-2010-0045200 | A | 5/2010 |
| KR | 10-2014-0095129 | A | 8/2014 |
| KR | 10-2014-0095131 | A | 8/2014 |
| WO | 2013/149347 | A1 | 10/2013 |

* cited by examiner

| | NOISE FIGURE(dB) | |
|---|---|---|
| FREQUENCY (MHz) | FIRST FEEDING POINT | SECOND FEEDING POINT |
| 1559 | 4.4 | 3.4 |
| 1575 | 4.3 | 3.4 |
| 1600 | 4.25 | 3.4 |
| 1610 | 4.21 | 3.5 |

| | NOISE FIGURE(dB) | |
|---|---|---|
| FREQUENCY (MHz) | FIRST FEEDING POINT | SECOND FEEDING POINT |
| 1559 | 2.4 | 1.78 |
| 1575 | 2.3 | 1.78 |
| 1600 | 2.3 | 1.75 |
| 1610 | 2.4 | 1.78 |

FIG. 16

| FREQUENCY (MHz) | AVERAGE GAIN [dBic] | PEAK GAIN [dBic] | ZENITH GAIN (ZENITH) [dBic] | AXIAL RATIO (AR) [dB] |
|---|---|---|---|---|
| 1559.0 | 23.09 | 29.85 | 29.60 | 2.44 |
| 1575.0 | 25.85 | 32.65 | 32.38 | 0.99 |
| 1592.0 | 26.38 | 33.11 | 32.91 | 0.98 |
| 1608.0 | 24.75 | 32.05 | 31.69 | 2.16 |

FIG. 17

| FREQUENCY (MHz) | AVERAGE GAIN [dBic] | PEAK GAIN [dBic] | ZENITH GAIN (ZENITH) [dBic] | AXIAL RATIO (AR) [dB] |
|---|---|---|---|---|
| 1559.0 | 27.11 | 33.15 | 33.01 | 1.08 |
| 1575.0 | 26.96 | 33.23 | 33.07 | 1.53 |
| 1592.0 | 29.82 | 35.42 | 35.28 | 2.20 |
| 1608.0 | 27.04 | 33.57 | 33.25 | 2.06 |

FIG. 19

| FREQUENCY BAND | CONVENTIONAL WIDEBAND PATCH ANTENNA | WIDEBAND PATCH ANTENNA OF PRESENT INVENTION |
|---|---|---|
| GPS | 45 | 46~48 |
| Glonass | 43~44 | 44~46 |
| Beidou | 40~41 | 42~43 |

WIDEBAND PATCH ANTENNA MODULE

TECHNICAL FIELD

The present invention relates to a patch antenna for an electronic device. More particularly, the present invention relates to a wideband patch antenna module for receiving a frequency in wideband including signals of a GPS frequency band and a GNSS frequency band.

Further, this application is a National Stage of International Application No. PCT/KR2014/012141, filed Dec. 10, 2014, which claims the benefit of Korean Patent Application No. 10-2014-0151182, filed Nov. 3, 2014, which are hereby incorporated by reference in their entirety into this application.

BACKGROUND ART

The global positioning system (GPS) is a military system developed by the United States Department of Defense. Since 2000, GPS access has been made available to civilians. Mostly, the GPS was used in the United States of America and in western countries, and recently, it has begun to be used in all countries of the world. The GPS is used in various application fields such as sailing maps of vessels, navigation devices of vehicles, mobile phones (smart phones) providing position information services, etc.

Most mobile terminals providing position information services are configured to use the GPS. Therefore, a GPS patch antenna is mounted in a mobile terminal to receive signals in the frequency band of about 1576 MHz, which is the frequency band of the GPS. For example, the GPS patch antenna is disclosed in Korean Patent No. 10-1105443 (title: ceramic patch antenna using GPS), Korean Utility Model Registration No. 20-0326365 (title: GPS patch antenna for improving axial ratio and return loss), etc.

In the meantime, the global navigation satellite system (GLONASS) was developed by Russia to compete with the GPS of the U.S.A. Like the GPS, GLONASS was also initially used for military purposes. However, recently, access to GLONASS has also been made available to civilians, and is now also applied to various application fields. GLONASS is composed of fewer satellites than that of the GPS, but provides more precise position information than the GPS. Thus, GLONASS is being increasingly used. Therefore, mobile terminals having GLONASS antennas to provide position information services using GLONASS are becoming increasingly popular.

Generally, GPS or GLONASS use is selectively determined according to countries. Thus, mobile terminal manufacturers manufacture mobile terminals by selectively mounting GPS antennas or GLONASS antennas according to countries where the mobile terminals are used.

When selectively mounting a GPS antenna or a GLONASS antenna in one mobile terminal, manufacturing lines should be separated. Such separation causes an increase in manufacturing costs of mobile terminals. Therefore, manufacturers are developing mobile terminals capable of using both the GPS and GLONASS.

A conventional GPS patch antenna is configured to receive signals in the frequency band of about 1576 MHz, and thus it is impossible to receive GLONASS signals which are about 1602 MHz.

Therefore, in order to manufacture mobile terminals capable of using both the GPS and GLONASS, it is required to mount a GPS antenna and a GLONASS antenna together.

However, recently, mobile terminals are reduced in size due to demands from the market and users. Thus, there are numerous design limitations in simultaneously mounting the GPS antenna and the GLONASS antenna, and costs of mobile terminals increase.

DISCLOSURE

Technical Problem

The present invention has been made keeping in mind the above problems occurring in the related art, and the present invention is intended to provide a wideband patch antenna module enhancing antenna performance such as noise figure, axial ratio, etc. by respectively coupling feeding points formed on an patch antenna to low-noise amplifiers and by coupling the low-noise amplifiers to a hybrid coupler.

Also, the present invention is intended to provide a wideband patch antenna module where two feeding points are formed on a lower patch at a preset angle therebetween, whereby ultra-wideband characteristics receiving both a GPS signal and a GLONASS signal may be realized, and antenna size and manufacturing costs may be minimized.

Also, the present invention is intended to provide a wideband patch antenna module where a feeding patch is formed at a side surface or a bottom surface of a base layer, whereby ultra-wideband characteristics receiving both a GPS signal and a GLONASS signal may be realized, and antenna size and manufacturing costs may be minimized.

Technical Solution

In order to accomplish the above object, there is provided a wideband patch antenna module including: a patch antenna receiving a signal transmitted from at least one of a GPS satellite, a GLONASS satellite, and a BeiDou satellite, and outputting linearly polarized signals through a first feeding point and a second feeding point in response to the received signal; a first low-noise amplifier coupled to the first feeding point, the first low-noise amplifier removing noise of a linearly polarized signal outputted from the first feeding point and amplifying the signal; a second low-noise amplifier coupled to the second feeding point, the second low-noise amplifier removing noise of a linearly polarized signal outputted from the second feeding point and amplifying the signal; and a hybrid coupler generating a phase difference to the linearly polarized signal outputted from one of the first low-noise amplifier and the second low-noise amplifier, and combining the linearly polarized signal to which the phase difference is generated with the linearly polarized signal outputted from a remaining amplifier so as to generate a circularly polarized signal.

According to another aspect, there is provided a wideband patch antenna module including: a base layer; a radiation patch provided on a top surface of the base layer; a lower patch provided at a bottom surface of the base layer; a first feeding point provided at a bottom surface of the lower patch; and a second feeding point provided at the bottom surface of the lower patch, wherein an imaginary line connecting the first feeding point and a center point of the lower patch intersects with an imaginary line connecting the second feeding point and the center point of the lower patch.

The lower patch may include a first feeding opening in which the first feeding point is inserted and a second feeding opening in which the second feeding point is inserted.

The imaginary line connecting the first feeding point and the center point of the lower patch may intersect with the imaginary line connecting the second feeding point and the center point of the lower patch at a preset angle in a range of 70 to 110 degree angles.

The wideband patch antenna module may include: a first low-noise amplifier coupled to the first feeding point, the first low-noise amplifier removing noise of a linearly polarized signal outputted from the first feeding point and amplifying the signal; a second low-noise amplifier coupled to the second feeding point, the second low-noise amplifier removing noise of a linearly polarized signal outputted from the second feeding point and amplifying the signal; and a hybrid coupler generating a phase difference to the linearly polarized signal outputted from one of the first low-noise amplifier and the second low-noise amplifier, and combining the linearly polarized signal to which the phase difference is generated with the linearly polarized signal outputted from a remaining amplifier so as to generate a circularly polarized signal.

According to still another aspect, there is provided a wideband patch antenna module including: a base layer; a radiation patch provided on a top surface of the base layer; a first feeding pin provided with a side that is in contact with a bottom surface of the radiation patch by passing through the base layer; and a second feeding pin provided with a side that is in contact with the bottom surface of the radiation patch by passing through the base layer, wherein an imaginary line connecting the first feeding pin and a center point of the base layer intersects with an imaginary line connecting the second feeding pin and the center point of the base layer.

The imaginary line connecting the first feeding pin and the center point of the base layer may intersect with the imaginary line connecting the second feeding pin and the center point of the base layer at a preset angle in a range of 70 to 110 degree angles.

The base layer may include a first feeding hole through which the first feeding pin is inserted and a second feeding hole through which the second feeding pin is inserted.

The wideband patch antenna module may include a lower patch provided with a third feeding hole through which the first feeding pin is inserted and with a fourth feeding hole through which the second feeding pin is inserted, the lower patch being provided at a bottom surface of the base layer.

The wideband patch antenna module may include: a first low-noise amplifier coupled to the first feeding pin, the first low-noise amplifier removing noise of a linearly polarized signal outputted from the first feeding pin and amplifying the signal; a second low-noise amplifier coupled to the second feeding pin, the second low-noise amplifier removing noise of a linearly polarized signal outputted from the second feeding pin and amplifying the signal; and a hybrid coupler generating a phase difference to the linearly polarized signal outputted from one of the first low-noise amplifier and the second low-noise amplifier, and combining the linearly polarized signal to which the phase difference is generated with the linearly polarized signal outputted from a remaining amplifier so as to generate a circularly polarized signal.

According to still another aspect, there is provided a wideband patch antenna module including: a base layer; a first feeding patch provided at at least one surface of a side surface and a bottom surface of the base layer; and a second feeding patch provided at at least one surface of another side surface and the bottom surface of the base layer at a location spaced apart from the first feeding patch, wherein the second feeding patch is provided at the side surface adjacent to the side surface of the base layer where the first feeding patch is provided.

The first feeding patch may include a first patch provided at the side surface of the base layer and a first extension part having a portion connected to the first patch and another portion extending to the bottom surface of the base layer.

The second feeding patch may include a second patch provided at the side surface of the base layer and a second extension part having a portion connected to the second patch and another portion extending to the bottom surface of the base layer.

The wideband patch antenna module may include a lower patch provided at the bottom surface of the base layer, the lower patch being provided with several slots in which the first feeding patch and the second feeding patch that are provided at the bottom surface of the base layer are respectively inserted.

An imaginary line connecting the first feeding patch and a center point of a radiation patch may intersect with an imaginary line connecting the second feeding patch and the center point of the radiation patch at a preset angle in a range of 70 to 110 degree angles.

The first feeding patch and the second feeding patch may be provided at the bottom surface of the base layer, and the second feeding patch may be provided at a side edge adjacent to a side edge of the bottom surface of the base layer where the first feeding patch is provided.

The wideband patch antenna module may include: a first low-noise amplifier coupled to the first feeding patch, the first low-noise amplifier removing noise of a linearly polarized signal outputted from the first feeding patch and amplifying the signal; a second low-noise amplifier coupled to the second feeding patch, the second low-noise amplifier removing noise of a linearly polarized signal outputted from the second feeding patch and amplifying the signal; and a hybrid coupler generating a phase difference to the linearly polarized signal outputted from one of the first low-noise amplifier and the second low-noise amplifier, and combining the linearly polarized signal to which the phase difference is generated with the linearly polarized signal outputted from a remaining amplifier so as to generate a circularly polarized signal.

Advantageous Effects

According to the present invention, the wideband patch antenna module can enhance antenna performance such as noise figure, axial ratio, etc. by respectively coupling the feeding points formed on the patch antenna to the low-noise amplifiers, and by coupling the low-noise amplifiers to a hybrid coupler. That is, in a conventional wideband patch antenna module where a feeding point of a patch antenna is coupled to a hybrid coupler, insertion loss occurs in providing a signal received by the patch antenna to the hybrid coupler. Thus, in the conventional wideband patch antenna module, noise increases due to the insertion loss, and antenna performance such as noise figure, axial ratio, etc. is degraded. In contrast, in the wideband patch antenna module according to an embodiment of the present invention, the low-noise amplifier removes noise of and amplifies the signal received by the patch antenna before providing to signal to the hybrid coupler, whereby occurrence of the insertion loss may be minimized. Accordingly, the wideband patch antenna module according to an embodiment of the present invention can minimize an increase in noise caused by the insertion loss, and can enhance antenna performance such as noise figure, axial ratio, etc.

Also, by forming the feeding patch at the side surface or the bottom surface of the base layer, the ultra-wideband patch antenna can realize ultra-wideband characteristics receiving both a GPS signal and a GLONASS signal. Also, it is possible to form the feeding patch through surface-mount devices (SMD), and thus antenna size and manufacturing costs can be minimized.

Also, by forming the lower patch at the side surface or the bottom surface of the base layer, the wideband patch antenna module can realize ultra-wideband characteristics receiving both a GPS signal and a GLONASS signal. Also, it is possible to form the lower patch through surface-mount devices (SMD), and thus antenna size and manufacturing costs can be minimized.

DESCRIPTION OF DRAWINGS

FIG. 16 is a view showing noise figure of a wideband patch antenna module according to an embodiment of the present invention.

FIGS. 17 and 18 are views for explaining antenna characteristics and radiation patterns of a conventional wideband patch antenna module.

FIGS. 19 and 20 are views for explaining antenna characteristics and radiation patterns of a wideband patch antenna module according to an embodiment of the present invention.

FIG. 21 is a view for explaining signal-to-noise ratio characteristics of a conventional wideband patch antenna module and of a wideband patch antenna module according to an embodiment of the present invention.

MODE FOR INVENTION

Hereinafter, the most preferred embodiment of the present invention will be described with reference to the accompanying drawings in order to describe the present invention in detail so that the technical spirit of the present invention can be easily embodied by those skilled in the art to which the present invention belongs.

Figure 1:
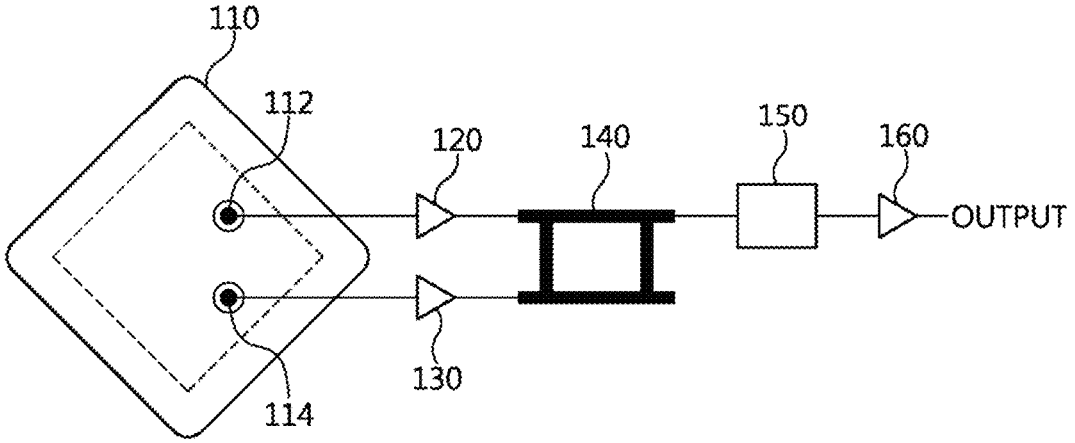
FIGS. 1 and 2 are views for explaining a wideband patch antenna module according to an embodiment of the present invention.

As shown in FIG. 1, a wideband patch antenna module includes: a patch antenna 110, a first low-noise amplifier 120, a second low-noise amplifier 130, a hybrid coupler 140, a saw filter 150, and a third low-noise amplifier.

The patch antenna 110 receives signals (namely, a frequency including position information) transmitted from a GPS satellite and a GLONASS satellite. The patch antenna 110 provides the received signals to the first low-noise amplifier 120 and the second low-noise amplifier 130 through a first feeding point 112 and a second feeding point 114. Here, the patch antenna 110 outputs the same linearly polarized signals through the first feeding point 112 and the second feeding point 114.

The first low-noise amplifier 120 is coupled to the first feeding point 112 of the patch antenna 110. The first low-noise amplifier 120 removes noise of the linearly polarized signal provided through the first feeding point 112. The first low-noise amplifier 120 amplifies the noise-removed linearly polarized signal and provides it to the hybrid coupler 140.

The second low-noise amplifier 130 is coupled to the second feeding point 114 of the patch antenna 110. The second low-noise amplifier 130 removes noise of the linearly polarized signal provided through the second feeding point 114. The second low-noise amplifier 130 amplifies the noise-removed linearly polarized signal and provides it to the hybrid coupler 140.

The hybrid coupler 140 transforms the linearly polarized signals provided from the first low-noise amplifier 120 and the second low-noise amplifier 130 into a circularly polarized signal. That is, the hybrid coupler 140 generates a 90° phase difference to the linearly polarized signal provided from the first low-noise amplifier 120 or the second low-noise amplifier 130. The hybrid coupler 140 outputs the circularly polarized signal by combining the linearly polarized signal to which the phase difference is generated and the other linearly polarized signal.

The saw filter 150 passes only a GPS signal and a GLONASS signal of the circularly polarized signal outputted from the hybrid coupler 140, and attenuates the remaining frequencies. That is, the saw filter 150 is configured by arranging two comb-like metal plates on opposite sides of a surface of a piezoelectric substrate by being irregular. In the saw filter 150, mechanical vibration (namely, a surface acoustic wave (SAW)) is generated on the surface of the piezoelectric substrate in response to input of a circularly polarized signal outputted from the hybrid coupler 140 from one direction. Thus, the circularly polarized signal is transformed into an electrical signal at the opposite direction. When frequency of the surface acoustic wave on the piezoelectric plate is different from frequency of the inputted circularly polarized signal, the signal is not provided and fades. Thus, the saw filter 150 operates as a band pass filter (BPF) passing only the GPS signal and the GLONASS signal of the circularly polarized signal and attenuating the remaining frequencies.

A third low-noise amplifier 160 removes noise of the circularly polarized signal that is filtered by the saw filter 150. The third low-noise amplifier 160 amplifies the noise-removed circularly polarized signal and outputs the amplified signal.

Figure 2:
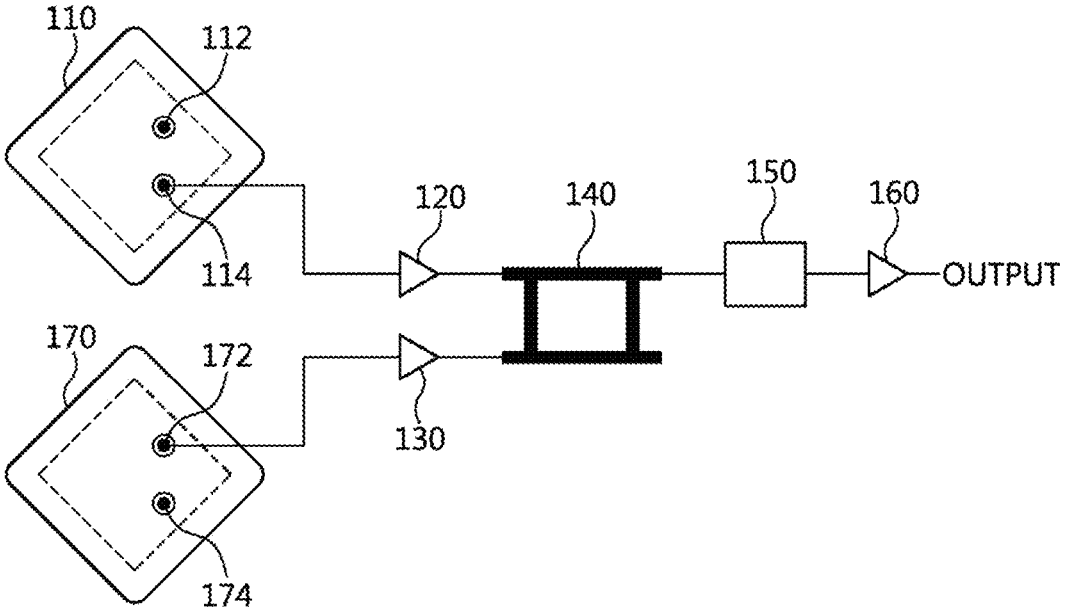

In the meantime, as shown in FIG. 2, a wideband patch antenna module may include a first patch antenna 110, a second patch antenna 170, a first low-noise amplifier 120, a second low-noise amplifier 130, a hybrid coupler 140, a saw filter 150, and a third low-noise amplifier 160. Here, since the hybrid coupler 140, the saw filter 150, and the third low-noise amplifier are the same as those of the wideband patch antenna module shown in FIG. 1, the detailed descriptions thereof will be omitted.

The first patch antenna 110 receives signals (namely, a frequency including position information) transmitted from a GPS satellite and a GLONASS satellite. The first patch antenna 110 provides the received signals to the first low-noise amplifier 120 through the first feeding point 112 or the second feeding point 114.

The second patch antenna 170 receives signals transmitted from the GPS satellite and the GLONASS satellite. The second patch antenna 170 provides the received signals to the second low-noise amplifier 130 through the first feeding point 172 or the second feeding point 174. Here, the second patch antenna 170 receives the signals of the same frequency band as that of the first patch antenna 110, and outputs linearly polarized signals related thereto.

The first low-noise amplifier 120 is coupled to a feeding point of the first patch antenna 110. The first low-noise amplifier 120 removes noise of the linearly polarized signal provided through the feeding point. The first low-noise amplifier 120 amplifies the noise-removed linearly polarized signal, and provides it to the hybrid coupler 140.

The second low-noise amplifier 130 is coupled to a feeding point of the second patch antenna 170. The second low-noise amplifier 130 removes noise of the linearly polarized signal provided through the feeding point. The second low-noise amplifier 130 amplifies the noise-removed linearly polarized signal, and provides it to the hybrid coupler 140.

Hereinafter, a first exemplary embodiment of the patch antenna of the wideband patch antenna module according to an embodiment of the present invention will be described in detail as follows with reference to the accompanying drawings.

Figure 3:
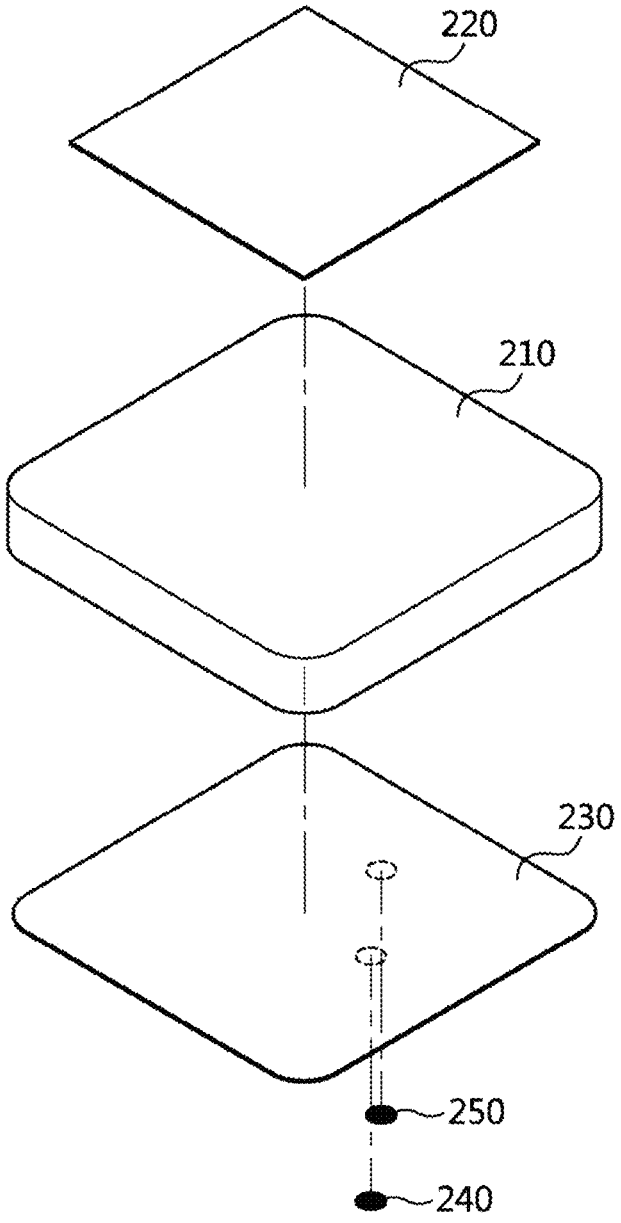
FIG. 3 is a view for explaining a first exemplary embodiment of a patch antenna of a wideband patch antenna module according to an embodiment of the present invention.
Figure 4:
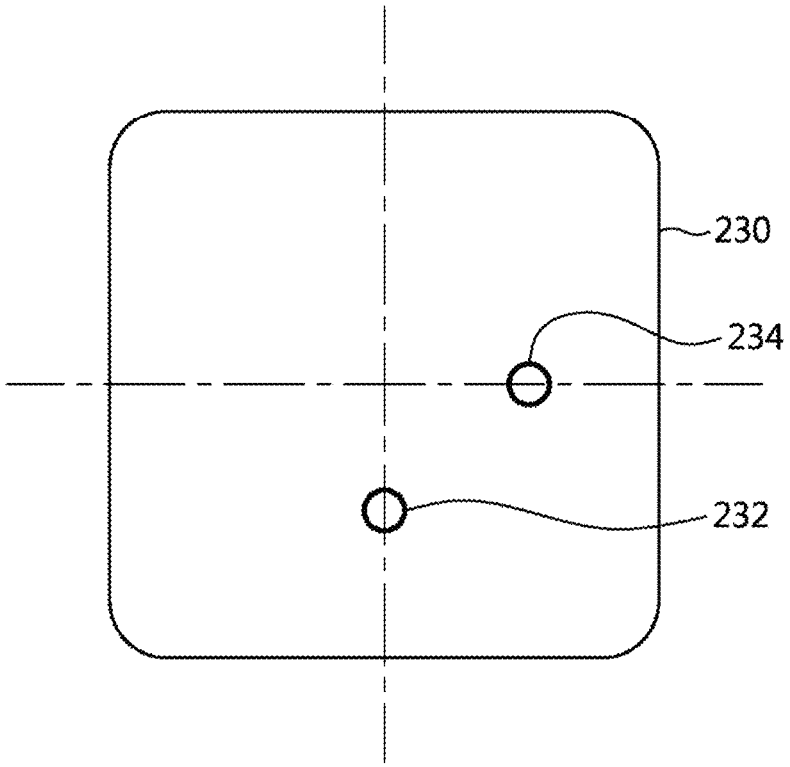
FIG. 4 is a view for explaining a lower patch of FIG. 3.

As shown in FIGS. 3 and 4, the patch antenna includes a base layer 210, a radiation patch 220, a lower patch 230, a first feeding point 240, and a second feeding point 250.

The base layer 210 is made of dielectric substances or magnetic substances. That is, the base layer 210 is formed as a dielectric substrate made of ceramics having characteristics such as high dielectric constant, low coefficient of thermal expansion, etc., or is formed as a magnetic substrate made of magnetic substances such as ferrite, etc.

The radiation patch 220 is formed on the top surface of the base layer 210. That is, the radiation patch 220 is a conductive sheet with high electrical conductivity such as copper, aluminum, gold, silver, etc., and is formed on the top surface of the base layer 210. Here, the radiation patch 220 is formed in a polygonal shape such as a quadrangular shape, a triangular shape, a circular shape, an octagonal shape, etc.

The radiation patch 220 operates through coupling feeding with the first feeding point 240 and the second feeding point 250, and receives the signals (namely, a frequency including position information) transmitted from a GPS satellite and a GLONASS satellite.

The lower patch 230 is formed at the bottom surface of the base layer 210. That is, the lower patch 230 is a conductive sheet with high electrical conductivity such as copper, aluminum, gold, silver, etc., and is formed at the bottom surface of the base layer 210.

The lower patch 230 may be provided with several feeding openings in which the first feeding point 240 and the second feeding point 250 are inserted. That is, as shown in FIG. 4, at the lower patch 230, a first feeding opening 232 in which the first feeding point 240 is inserted and a second feeding opening 234 in which the second feeding point 250 is inserted are formed. Here, the first feeding opening 232 is formed as having larger area than the first feeding point 240 so as to fit over the first feeding point 240 with a predetermined gap defined therebetween. The second feeding opening 234 is formed as having larger area than the second feeding point 250 so as to fit over the second feeding point 250 with a predetermined gap defined therebetween.

The first feeding point 240 and the second feeding point 250 are formed inside of the lower patch 230. That is, the first feeding point 240 and the second feeding point 250 are formed lower inside of the lower patch 230. Here, the first feeding point 240 and the second feeding point 250 are coupled to a feeding unit (not shown) of an electronic device, and receive power. The first feeding point 240 and the second feeding point 250 supply power to the radiation patch 220 through coupling feeding with the radiation patch 220 that is formed on the top surface of the base layer 210.

The first feeding point 240 and the second feeding point 250 may be formed as being inserted in feeding openings of the lower patch 230. That is, the first feeding point 240 is formed as being inserted in the first feeding opening 232 of the lower patch 230, and the second feeding point 250 is formed as being inserted in the second feeding opening 234 of the lower patch 230. Here, the first feeding point 240 is formed as being fitted in the outer circumference of the first feeding opening 232 with a predetermined gap defined therebetween. The second feeding point 250 is formed as being fitted in the outer circumference of the second feeding opening 234 with a predetermined gap defined therebetween.

Figure 5:
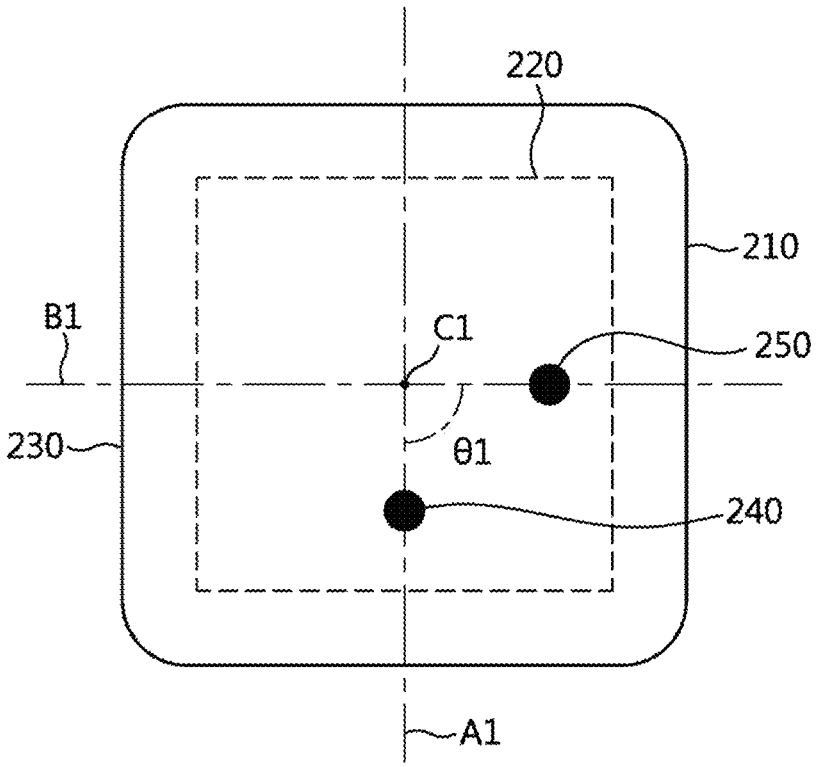
FIG. 5 is a view for explaining a first feeding point and a second feeding point of FIG. 3.

The first feeding point 240 and the second feeding point 250 are placed at a preset angle therebetween on the basis of the center of the lower patch 230. That is, as shown in FIG. 5, an imaginary line A1 connecting the first feeding point 240 and the center point C1 of the lower patch 230 intersects with an imaginary line B1 connecting the second feeding point 250 and the center point C1 of the lower patch 230 at a preset angle θ1. Here, it is desirable to set the preset angle θ1 to 90 degree angles. The preset angle may be set in a range of 70 to 110 degree angles.

Figure 6:
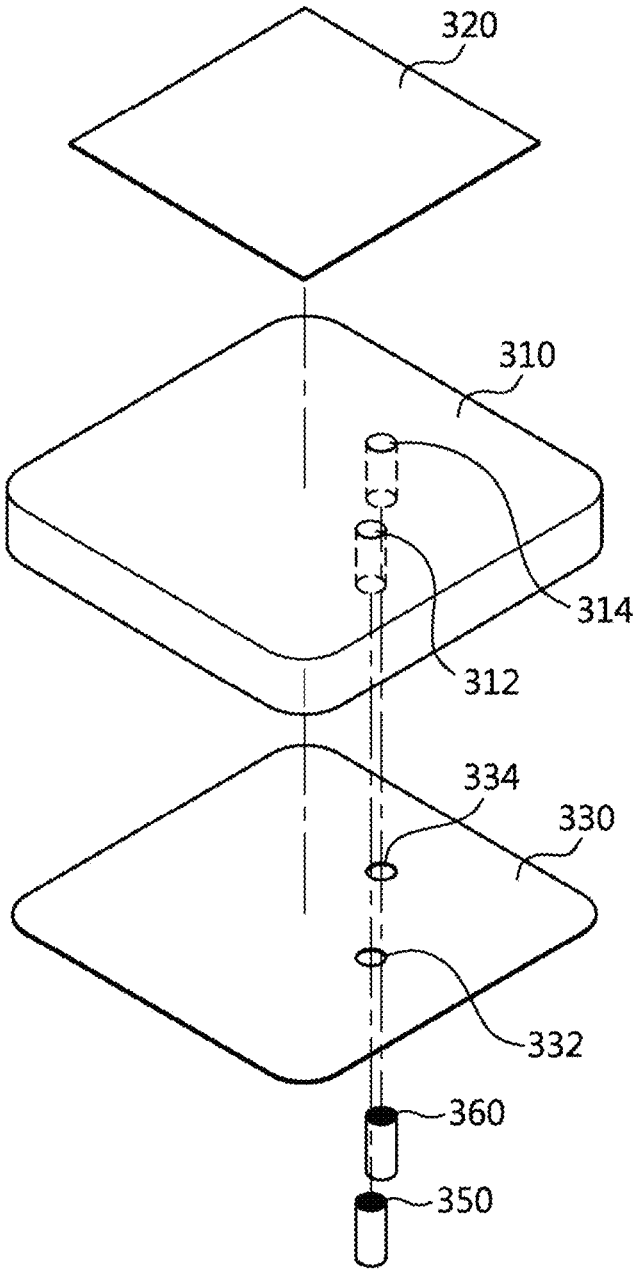
FIGS. 6 and 7 are views for explaining a second exemplary embodiment of a patch antenna of a wideband patch antenna module according to an embodiment of the present invention.
Figure 7:
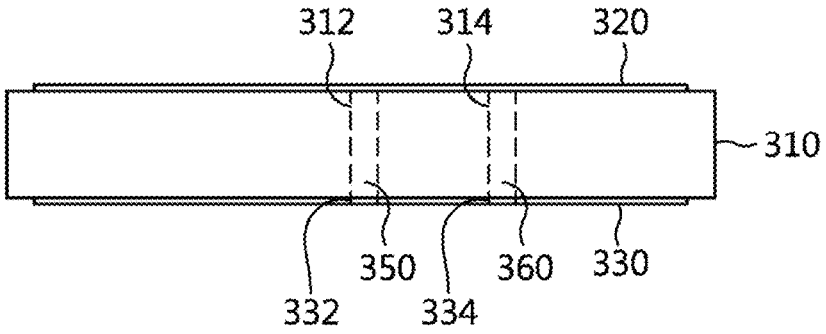

FIGS. 6 and 7 are views for explaining a second exemplary embodiment of a patch antenna of a wideband patch antenna module according to an embodiment of the present invention.

Referring to FIGS. 6 and 7, the patch antenna includes a base layer 310, a radiation patch 320, a lower patch 330, a first feeding pin 350, and a second feeding pin 360.

The base layer 310 is made of dielectric substances or magnetic substances. That is, the base layer 310 is formed as a dielectric substrate made of ceramics having characteristics such as high dielectric constant, low coefficient of thermal expansion, etc., or is formed as a magnetic substrate made of magnetic substances such as ferrite, etc.

The base layer 310 is provided with several feeding holes. That is, at the base layer 310, a first feeding hole 312 through which the first feeding pin 350 is inserted and a second feeding hole 314 through which the second feeding pin 360 is inserted are formed. Here, an imaginary line connecting the first feeding hole 312 and the center point of the base layer 310 intersects with an imaginary line connecting the second feeding hole 314 and the center point of the base layer 310 at a preset angle. Here, it is desirable to set the preset angle to 90 degree angles. The preset angle may be set in a range of 70 to 110 degree angles.

The radiation patch 320 is formed on the top surface of the base layer 310. That is, the radiation patch 320 is a conductive sheet with high electrical conductivity such as copper, aluminum, gold, silver, etc., and is formed on the top surface of the base layer 310. Here, the radiation patch 320 is formed in a polygonal shape such as a quadrangular shape, a triangular shape, a circular shape, an octagonal shape, etc.

The bottom surface of the radiation patch 320 is in contact with the first feeding pin 350 and the second feeding pin 360. The radiation patch 320 is fed with power through the first feeding pin 350 and the second feeding pin 360, and receives signals (namely, a frequency including position information) transmitted from a GPS satellite and a GLONASS satellite.

The lower patch 330 is formed at the bottom surface of the base layer 310. That is, the lower patch 330 is a conductive sheet with electrical conductivity such as copper, aluminum, gold, silver, etc., and is formed at the bottom surface of the base layer 310.

The lower patch 330 is provided with several feeding holes through which the first feeding pin 350 and the second feeding pin 360 are inserted. That is, at the lower patch 330, a third feeding hole 332 through which the first feeding pin 350 is inserted and a fourth feeding hole 334 through which the second feeding pin 360 is inserted are provided. Here, an imaginary line connecting the third feeding hole 332 and the center point of the lower patch 330 intersects with an imaginary line connecting the fourth feeding hole 334 and the center point of the lower patch 330 at a preset angle. Here, it is desirable to set the preset angle to 90 degree angles. The preset angle may be set in a range of 70 to 110 degree angles.

Here, the third feeding hole 332 is formed as having larger area than the first feeding pin 350 so as to fit over the first feeding pin 350 with a predetermined gap defined therebetween. The fourth feeding hole 334 is formed as having larger area than the second feeding pin 350 so as to fit over the second feeding pin 360 with a predetermined gap defined therebetween.

One side of the first feeding pin 350 and one side of the second feeding pin 360 are inserted through the feeding holes formed at the lower patch 330 and at the base layer 310, and are in contact with the bottom surface of the radiation patch 320. Here, the opposite side of the first feeding pin 350 and the opposite side of the second feeding pin 360 are coupled to a feeding unit (not shown) of an electronic device, and receives power. The first feeding pin 350 and the second feeding pin 360 are in contact with the bottom surface of the radiation patch 320 that is formed on the top surface of the base layer 310, and supply power to the radiation patch 320.

The first feeding pin 350 and the second feeding pin 360 are inserted through the feeding holes formed at the lower patch 330 and at the base layer 310, and are placed at a preset angle therebetween on the basis of the center portion. That is, an imaginary line connecting the first feeding pin 350 and the center point of the lower patch 330 intersects with an imaginary line connecting the second feeding pin 360 and the center point of the lower patch 330 at a preset angle. An imaginary line connecting the first feeding pin 350 and the center point of the base layer 310 intersects with an imaginary line connecting the second feeding pin 360 and the center point of the base layer 310 at a preset angle. Here, it is desirable to set the preset angle to 90 degree angles. The preset angle may be set in a range of 70 to 110 degree angles.

Here, the first feeding pin 350 and the second feeding pin 360 are previously produced in pin shapes by using conductive materials with high electrical conductivity such as copper, aluminum, gold, silver, etc. The first feeding pin 350 and the second feeding pin 360 may be produced by injecting conductive materials with high electrical conductivity such as copper, aluminum, gold, silver, etc. into feeding holes formed at the base layer 310 and at the lower patch 330 after stacking the base layer 310, the radiation patch 320, and the lower patch 330 and forming a small body.

Figure 8:
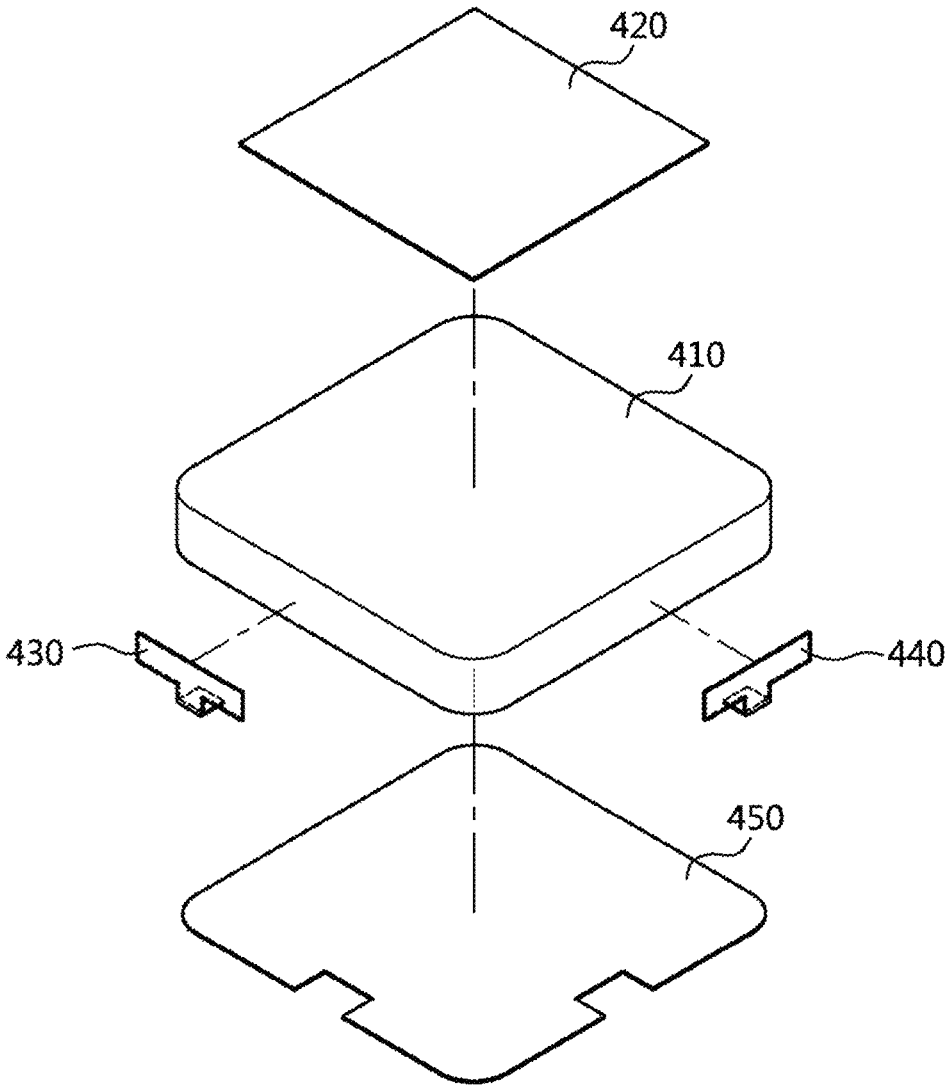
FIG. 8 is a view for explaining a third exemplary embodiment of a patch antenna of a wideband patch antenna module according to an embodiment of the present invention.
Figure 9:
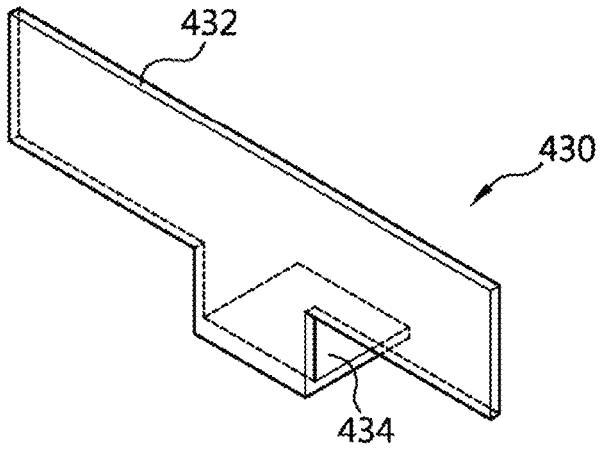
FIGS. 9 to 11 are views for explaining a first feeding patch and a second feeding patch of FIG. 8.
Figure 10:
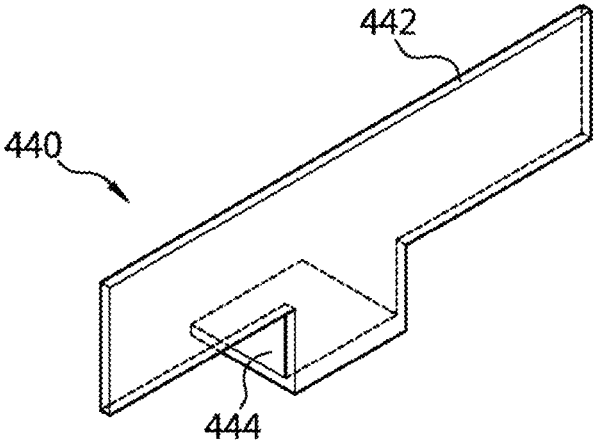
Figure 11:
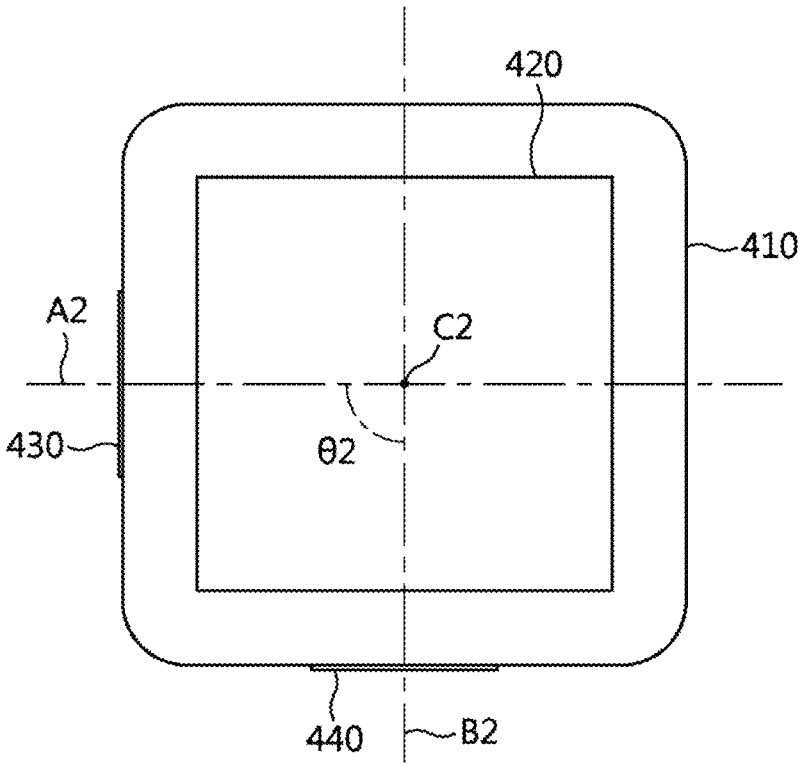
Figure 12:
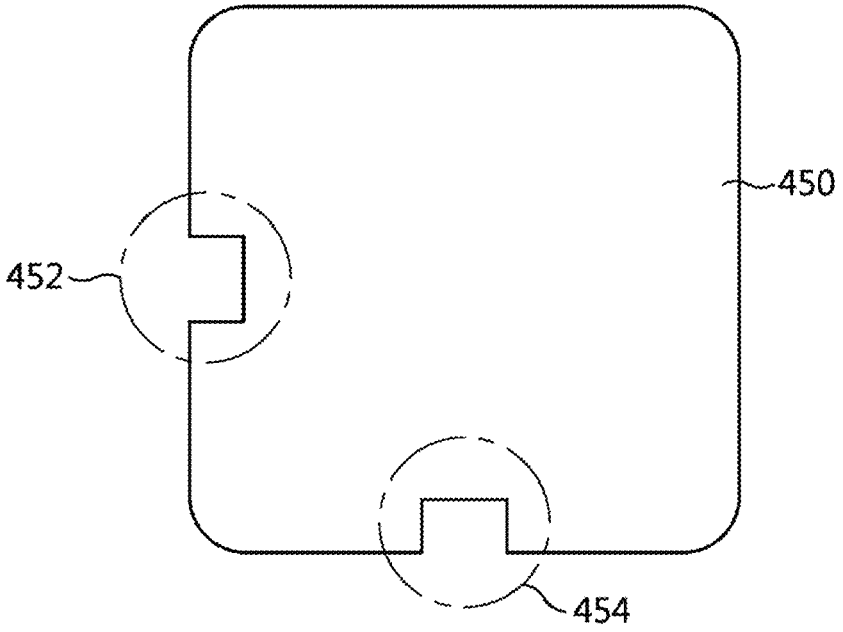
FIG. 12 is a view for explaining a lower patch of FIG. 8.

FIG. 8 is a view for explaining a third exemplary embodiment of a patch antenna of a wideband patch antenna module according to an embodiment of the present invention. FIGS. 9 to 11 are views for explaining a first feeding patch and a second feeding patch of FIG. 8, and FIG. 12 is a view for explaining a lower patch of FIG. 8.

As shown in FIG. 8, an ultra-wideband patch antenna includes a base layer 410, a radiation patch 420, a first feeding patch 430, a second feeding patch 440, and a lower patch 450.

The base layer 410 is made of dielectric substances or magnetic substances. That is, the base layer 410 is formed as a dielectric substrate mode of ceramics having characteristics such as high dielectric constant, low coefficient of thermal expansion, etc., or is formed as a magnetic substrate made of magnetic substances such as ferrite, etc.

The radiation patch 420 is formed on the top surface of the base layer 410. That is, the radiation patch 420 is a conductive sheet with high electrical conductivity such as copper, aluminum, gold, silver, etc., and is formed on the top surface of the base layer 410. Here, the radiation patch 420 is formed in a polygonal shape such as a quadrangular shape, a triangular shape, a circular shape, an octagonal shape, etc.

The radiation patch 420 operates through coupling feeding with the first feeding patch 430 and the second feeding patch 440, and receives the signals (namely, a frequency including position information) transmitted from a GPS satellite and a GLONASS satellite.

The first feeding patch 430 is formed at the side surface and the bottom surface of the base layer 410. That is, the first feeding patch 430 has one side formed at the side surface of the base layer 410 and another side formed at the bottom surface of the base layer 410.

For example, as shown in FIG. 9, the first feeding patch 430 is produced in "T" shape having an upper portion with a first patch 432 (namely, "-" shape) formed at the side surface of the base layer 410 and having a lower portion with a first extension part 434 (namely, "↑" shape) of which a portion is bent and formed at the bottom surface of the base layer 410.

In addition, the first feeding patch 430 may be produced in various shapes including the first patch 432 formed at the side surface of the base layer 410, and the first extension part 434 having a portion connected to the first patch 432 and having another portion extending to the bottom surface of the base layer.

The first feeding patch 430 is coupled to a feeding unit (not shown) of an electronic device, and receives power. The first feeding patch 430 supplies power received through the first extension part 434, to the radiation patch 420 through coupling feeding between the radiation patch 420 and the first patch 432.

The second feeding patch 440 is formed at a side surface and the bottom surface of the base layer 410. That is, the second feeding patch 440 has one side formed at the side surface of the base layer 410 and another side formed at the bottom surface of the base layer 410.

For example, as shown in FIG. 10, the second feeding patch 440 is produced in "T" shape having an upper portion with a second patch 442 (namely, "–" shape) formed at the side surface of the base layer 410 and having a lower portion with a second extension part 444 (namely, "|" shape) of which a portion is bent and formed at the bottom surface of the base layer 410.

In addition, the second feeding patch 440 may be produced in various shapes including the second patch 442 formed at the side surface of the base layer 410, and the second extension part 444 having a portion connected to the second patch 442 and having another portion extending to the bottom surface of the base layer 410.

The second feeding patch 440 is coupled to a feeding unit (not shown) of an electronic device, and receives power. The second feeding patch 440 supplies power received through the second extension part 444, to the radiation patch 420 through coupling feeding between the radiation patch 420 and the second patch 442. Here, the second feeding patch 440 is formed at the side surface that is adjacent to the side surface of the base layer 410 where the first feeding patch 430 is formed.

Therefore, as shown in FIG. 11, an imaginary line A2 connecting the center of the first feeding patch 430 and the center point C2 of the radiation patch 420 intersects with an imaginary line B2 connecting the second feeding patch 440 and the center point C2 of the radiation patch 420 at a preset angle θ2. Here, it is desirable to set the preset angle θ2 to 90 degree angles. The preset angle may be set in a range of 70 to 110 degree angles.

The first feeding patch 430 is formed on the imaginary line A2 connecting the center of the first feeding patch 430 and the center point C2 of the radiation patch 420, and the second feeding patch 440 is formed on the imaginary line B2 connecting the second feeding patch 440 and the center point C2 of the radiation patch 420, whereby the preset angle can be always secured.

The lower patch 450 is formed at the bottom surface of the base layer 410. That is, the lower patch 450 is a conductive sheet with high electrical conductivity such as copper, aluminum, gold, silver, etc., and is formed at the bottom surface of the base layer 410.

The lower patch 450 is provided with several slots. That is, as shown in FIG. 12, at the lower patch 450, a first slot 452 to which the first extension part 434 of the first feeding patch 430 formed at the bottom surface of the base layer 410 is inserted and a second slot 454 to which the second extension part 444 of the second feeding patch 440 are formed. Here, the first slot 452 is formed as having larger area than the first extension part 434 so as to be spaced apart from the first extension part 434 by a predetermined gap. The second slot 454 is formed as having larger area than the second extension part 444 so as to be spaced apart from the second extension part 444 by a predetermined gap.

Figure 13:
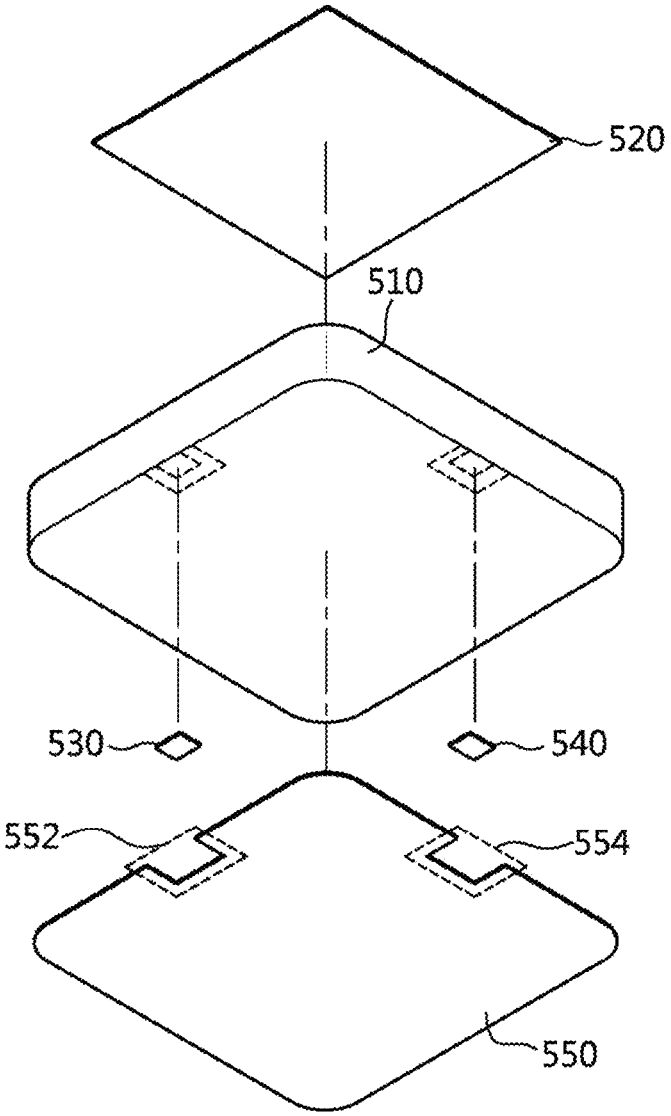
FIG. 13 is a view for explaining a fourth exemplary embodiment of a patch antenna of a wideband patch antenna module according to an embodiment of the present invention.
Figures 14, 15:
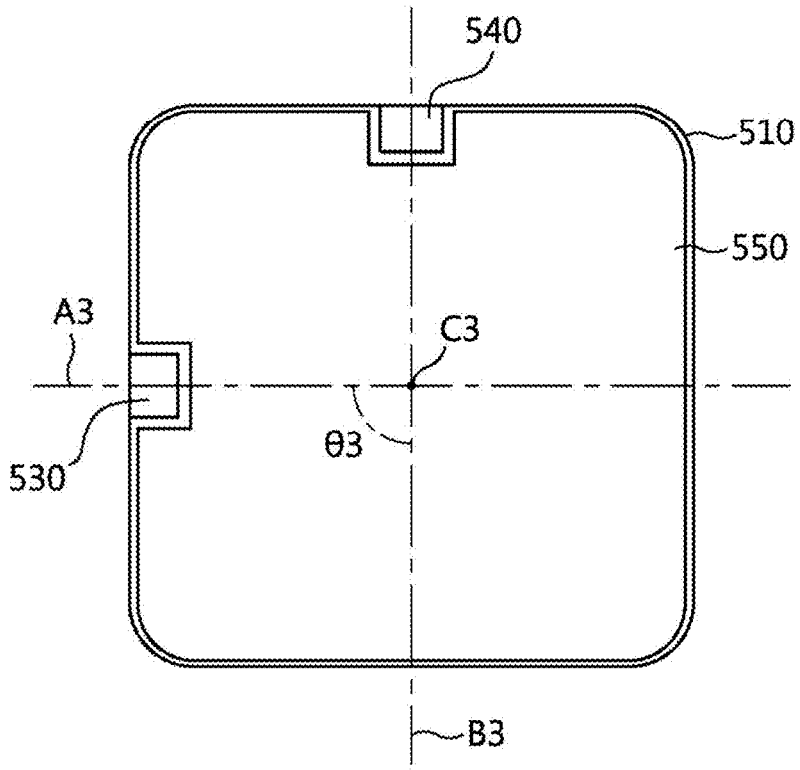
FIG. 14 is a view for explaining a first feeding patch and a second feeding patch of FIG. 13.
FIG. 15 is a view showing noise figure of a conventional wideband patch antenna module.

FIG. 13 is a view for explaining a fourth exemplary embodiment of the patch antenna of the wideband patch antenna module according to an embodiment of the present invention. FIG. 14 is a view for explaining the first feeding patch and the second feeding patch of FIG. 13.

As shown in FIG. 13, the patch antenna includes a base layer 510, a radiation patch 520, a first feeding patch 530, a second feeding patch 540, and a lower patch 50. Here, since the base layer 510 and the radiation patch 520 are the same as the base layer 510 and the radiation patch 520 of the first exemplary embodiment, detailed description thereof will be omitted.

The first feeding patch 530 is formed at the bottom surface of the base layer 510. That is, the first feeding patch 530 is formed in a polygonal shape, and is formed at a side portion of the bottom surface (namely, a position adjacent to a side edge of the bottom surface) of the base layer 510. Here, the first feeding patch 530 is coupled to a feeding unit (not shown) of an electronic device, and receives power. The first feeding patch 530 supplies power to the radiation patch 520 through coupling feeding with the radiation patch 520.

The second feeding patch 540 is formed at the bottom surface of the base layer 510. That is, the second feeding patch 540 is formed in a polygonal shape, and is formed at a side portion of the bottom surface (namely, a position adjacent to a side edge of the bottom surface) of the base layer 510. Here, the second feeding patch 540 is formed at the side edge that is adjacent to the side edge of the bottom surface of the base layer 510 where the first feeding patch 530 is formed.

Therefore, as shown in FIG. 14, an imaginary line A3 connecting the center of the first feeding patch 530 and the center point C3 of the lower patch 550 intersects with an imaginary line B3 connecting the second feeding patch 540 and the center point C3 of the lower patch 550 at a preset angle θ3. Here, it is desirable to set the preset angle θ3 to 90 degree angles. The preset angle may be set in a range of 70 to 110 degree angles.

The second feeding patch 540 is coupled to a feeding unit (not shown) of an electronic device, and receives power. The second feeding patch 540 supplies power to the radiation patch 520 through coupling feeding with the radiation patch 520.

The lower patch 550 provided with several slots is formed at the bottom surface of the base layer 510. That is, at the lower patch 550, a first slot 552 to which the first feeding patch 530, formed at the bottom surface of the base layer 510, is inserted and a second slot 554 to which the second feeding patch 540 is inserted are formed. Here, the first slot 552 is formed as having larger area than the first feeding patch 530 so as to be spaced apart from the first feeding patch 530 by a predetermined gap. The second slot 554 is formed as having larger area than the second feeding patch 540 so as to be spaced apart from the second feeding patch 540 by a predetermined gap.

Hereinafter, characteristics of the wideband patch antenna module according to an embodiment of the present invention will be described in detail as follows with reference to the accompanying drawings.

FIG. 15 is a view showing noise figure of a conventional wideband patch antenna module. FIG. 16 is a view showing noise figure of a wideband patch antenna module according to an embodiment of the present invention.

Referring to FIG. 15, in a case of the conventional wideband patch antenna module, in the frequency band ranging 1599 MHz to 1610 MHz, noise figure of the first feeding point ranges from about 4.21 dB to about 4.4 dB, and noise figure of the second feeding point ranges from about 3.4 dB to about 3.5 dB.

Referring to FIG. 16, in a case of the wideband patch antenna module according to an embodiment of the present invention, in the frequency band ranging 1599 MHz to 1610 MHz, noise figure of the first feeding point ranges from about 2.3 dB to about 2.4 dB, and noise figure of the second feeding point ranges from about 1.75 dB to about 1.78 dB.

Accordingly, in comparison with the conventional wideband patch antenna module, the wideband patch antenna module according to an embodiment of the present invention has noise figure that is enhanced (reduced) by a degree ranging from about 1.5 dB to about 2.0 dB.

Figure 18:
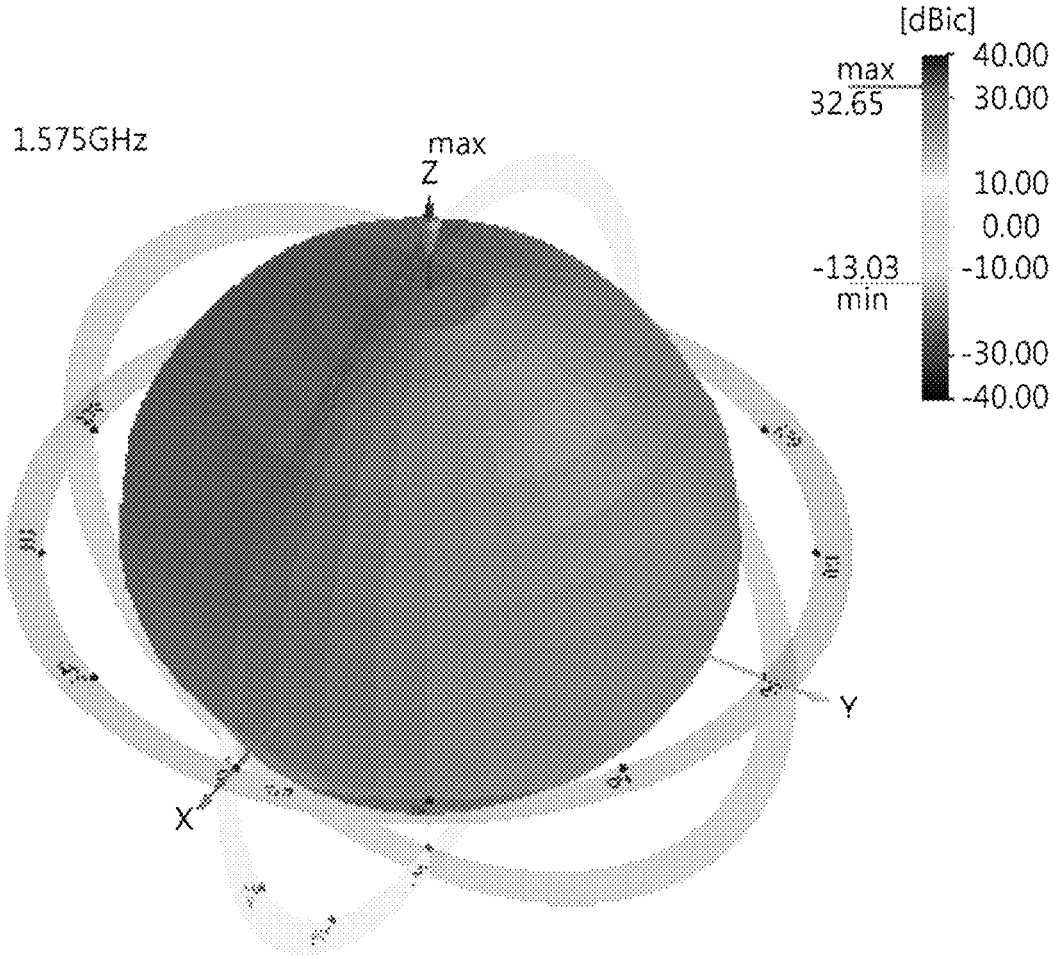
Figures 20, 21:
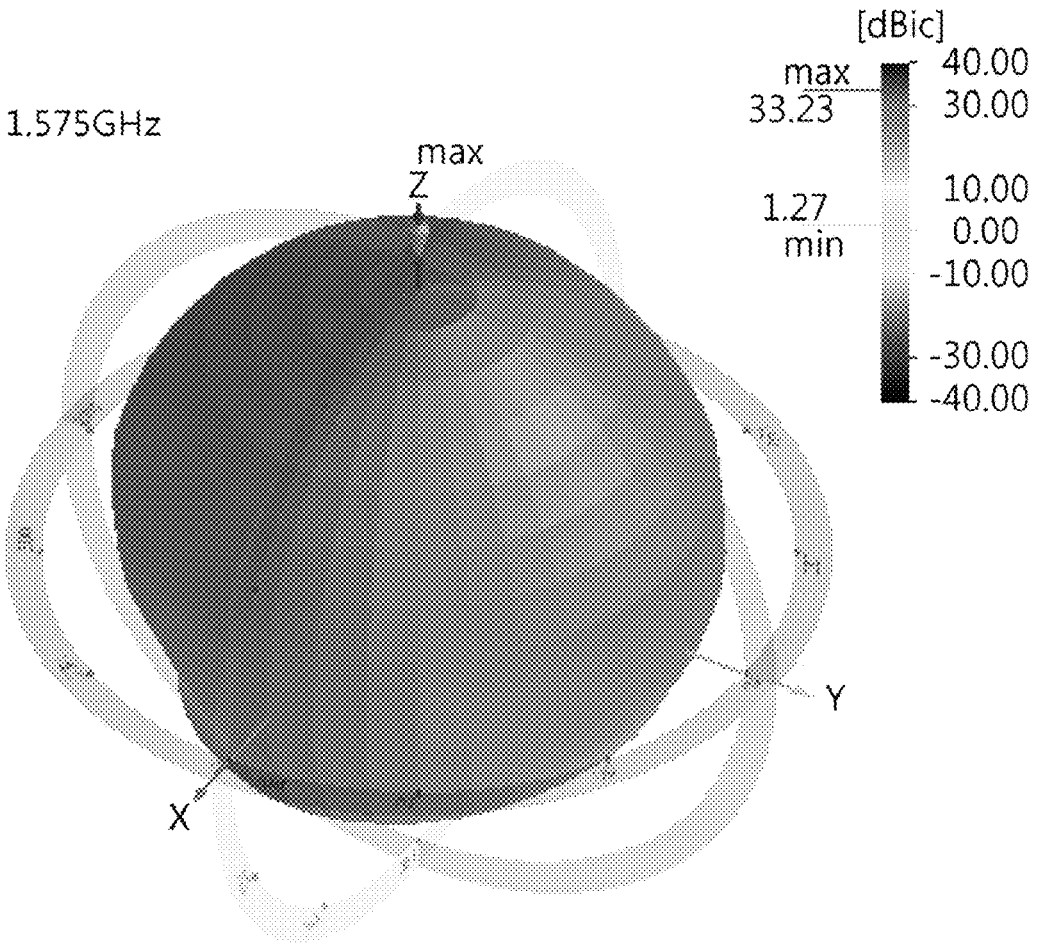

FIGS. 17 and 18 are views for explaining antenna characteristics and radiation patterns of a conventional wideband patch antenna module. FIGS. 19 and 20 are views for explaining antenna characteristics and radiation patterns of a wideband patch antenna module according to an embodiment of the present invention.

Referring to FIGS. 17 and 18, in a case of the wideband patch antenna module, in the frequency band ranging 1599 MHz to 1608 MHz, average gain ranges from about 23.09 dBic to about 26.38 dBic, peak gain ranges from about 29.85 dBic to about 33.11 dBic, zenith gain ranges from about 29.60 dBic to about 32.91 dBic, and axial ratio ranges from about 0.98 dB to about 2.44 dB.

Referring to FIGS. 19 and 20, in a case of the wideband patch antenna module according to an embodiment of the present invention, in the frequency band ranging 1599 MHz to 1608 MHz, average gain ranges from about 26.96 dBic to about 29.82 dBic, peak gain ranges from about 33.15 dBic to about 35.42 dBic, zenith gain ranges from about 33.01 dBic to about 35.28 dBic, and axial ratio ranges from about 1.08 dB to about 2.20 dB.

Accordingly, in comparison with the conventional wideband patch antenna module, the wideband patch antenna module according to an embodiment of the present invention has enhanced average gain, peak gain, zenith gain, and axial ratio.

FIG. 21 is a view for explaining signal-to-noise ratio characteristics of a conventional wideband patch antenna module and of a wideband patch antenna module according to an embodiment of the present invention.

In a case of the conventional wideband patch antenna, signal-to-noise ratio is about 45 dB in a GPS frequency band, and signal-to-noise ratio ranges from about 43 dB to about 44 dB in a GLONASS frequency band, and signal-to-noise ratio ranges from about 40 dB to about 41 dB in a BeiDou frequency band.

In a case of the wideband patch antenna module according to an embodiment of the present invention, signal-to-noise ratio ranges from about 46 dB to 48 dB in a GPS frequency band, signal-to-noise ratio ranges from about 44 dB to about 46 dB in a GLONASS frequency band, and signal-to-noise ratio ranges from about 42 dB to about 43 dB in a BeiDou frequency band.

Accordingly, in comparison with the conventional wideband patch antenna module, the wideband patch antenna module according to an embodiment of the present invention has enhanced signal-to-noise ratio by a degree ranging from about 1 dB to about 3 dB.

Although the preferred embodiments of the present invention have been disclosed for illustrative purposes, those skilled in the art will appreciate that various modifications and changes are possible, without departing from the scope and spirit of the invention as disclosed in the accompanying claims.

The invention claimed is:

1. A wideband patch antenna module comprising:

a base layer;

a radiation patch provided on a top surface of the base layer;

a lower patch provided at a bottom surface of the base layer;

a first feeding point provided at a bottom surface of the lower patch;

a second feeding point provided at the bottom surface of the lower patch;

a first low-noise amplifier coupled to the first feeding point, the first low-noise amplifier removing noise of a linearly polarized signal outputted from the first feeding point and amplifying the linearly polarized signal outputted from the first feeding point;

a second low-noise amplifier coupled to the second feeding point, the second low-noise amplifier removing noise of a linearly polarized signal outputted from the second feeding point and amplifying the linearly polarized signal outputted from the second feeding point;

a hybrid coupler generating a phase difference to the linearly polarized signal amplified from one of the first low-noise amplifier and the second low-noise amplifier, and combining the linearly polarized signal to which the phase difference is generated with the linearly polarized signal outputted from a remaining amplifier so as to generate a circularly polarized signal; and a saw filter passing only a GPS signal and a GLONASS signal of the circularly polarized signal and attenuating remaining frequencies, wherein an imaginary line connecting the first feeding point and a center point of the lower patch intersects with an imaginary line connecting the second feeding point and the center point of the lower patch.

2. The wideband patch antenna module of claim 1, wherein the lower patch includes:

a first feeding opening in which the first feeding point is inserted; and a second feeding opening in which the second feeding point is inserted.

3. The wideband patch antenna module of claim 1, wherein the imaginary line connecting the first feeding point and the center point of the lower patch intersects with the imaginary line connecting the second feeding point and the center point of the lower patch at a preset angle in a range of 70 to 110 degree angles.

4. A wideband patch antenna module comprising:

a base layer;

a radiation patch provided on a top surface of the base layer;

a first feeding pin provided with a side that is in contact with a bottom surface of the radiation patch by passing through the base layer;

a second feeding pin provided with a side that is in contact with the bottom surface of the radiation patch by passing through the base layer;

a first low-noise amplifier coupled to the first feeding pin, the first low-noise amplifier removing noise of a linearly polarized signal outputted from the first feeding pin and amplifying the linearly polarized signal outputted from the first feeding pin;

a second low-noise amplifier coupled to the second feeding pin, the second low-noise amplifier removing noise of a linearly polarized signal outputted from the second feeding pin and amplifying the linearly polarized signal outputted from the second feeding pin;

a hybrid coupler generating a phase difference to the linearly polarized signal amplified from one of the first low-noise amplifier and the second low-noise amplifier, and combining the linearly polarized signal to which the phase difference is generated with the linearly polarized signal outputted from a remaining amplifier so as to generate a circularly polarized signal; and a saw filter passing only a GPS signal and a GLONASS signal of the circularly polarized signal and attenuating remaining frequencies, wherein an imaginary line connecting the first feeding pin and a center point of the base layer intersects with an imaginary line connecting the second feeding pin and the center point of the base layer.

5. The wideband patch antenna module of claim 4, wherein the imaginary line connecting the first feeding pin and the center point of the base layer intersects with the imaginary line connecting the second feeding pin and the center point of the base layer at a preset angle in a range of 70 to 110 degree angles.

6. The wideband patch antenna module of claim 4, wherein the base layer includes:

a first feeding hole through which the first feeding pin is inserted; and a second feeding hole through which the second feeding pin is inserted.

7. The wideband patch antenna module of claim 4, further comprising:

a lower patch provided with a third feeding hole through which the first feeding pin is inserted and with a fourth feeding hole through which the second feeding pin is inserted, the lower patch being provided at a bottom surface of the base layer.

* * * * *